United States Patent [19]

Nakanishi

[11] Patent Number: 4,801,279

[45] Date of Patent: Jan. 31, 1989

[54] SHAPE MEMORY ALLOY SPRING CONNECTION ASSSEMBLY

[75] Inventor: Takao Nakanishi, Takaichi, Japan

[73] Assignee: Sharp Kabushiki Kaisha, Osaka, Japan

[21] Appl. No.: 117,422

[22] Filed: Nov. 2, 1987

Related U.S. Application Data

[63] Continuation of Ser. No. 733,309, May 13, 1985, abandoned.

[30] Foreign Application Priority Data

Jul. 18, 1984 [JP] Japan ..... 59-109748[U]

[51] Int. Cl.[4] ..... H01R 4/18

[52] U.S. Cl. ..... 439/877; 174/DIG. 8

[58] Field of Search ..... 439/877–882; 174/DIG. 8; 148/402; 354/266

[56] References Cited

U.S. PATENT DOCUMENTS

| | | | |
|---|---|---|---|
| 2,327,650 | 8/1943 | Klein | 339/276 R X |
| 2,375,481 | 5/1945 | Lee et al. | 339/276 R |
| 3,568,130 | 3/1971 | Hurst | 339/276 T X |
| 3,883,885 | 5/1975 | Orlando | 354/266 X |
| 4,002,954 | 1/1977 | Orlando | 148/402 X |
| 4,135,743 | 1/1979 | Hughes | 174/DIG. 8 X |
| 4,462,651 | 7/1984 | McGaffigan | 339/DIG. 1 X |

FOREIGN PATENT DOCUMENTS

| | | | |
|---|---|---|---|
| 2625893 | 12/1977 | Fed. Rep. of Germany | 339/143 R |

*Primary Examiner*—Eugene F. Desmond

*Attorney, Agent, or Firm*—Birch, Stewart, Kolasch & Birch

[57] ABSTRACT

A connector device for connecting a shape memory alloy spring to connector terminals which feed power to a connector of the shape memory alloy spring utilizing crimped connections applied to more than two portions of the connector terminal.

2 Claims, 1 Drawing Sheet

SHAPE MEMORY ALLOY SPRING CONNECTION ASSSEMBLY

This application is a continuation of application Ser. No. 733,309 filed on May 13, 1985, now abandoned.

BACKGROUND OF THE INVENTION

The present invention relates to a device used to connect a shape memory alloy spring to the connector terminals which supply the connector of the shape memory alloy spring with power.

Normally when the initial force is memorized and heat is generated by power fed directly to the shape memory alloy spring, the ends of the shape memory alloy spring and the power supply line can be easily connected by crimping. The crimping is applied via the connector terminals to both ends of the shape memory alloy spring. However, if the shape memory alloy spring is operated too often or if the force generated by the shape memory alloy spring as it returns to its initial shape is too strong, the mechanical and electrical strength of the crimped portion of the connector terminals are weakened. This eventually causes a deterioration in the power conduction due to poor connection and poor contact resulting from a weakened tensile strength.

OBJECT AND SUMMARY OF THE INVENTION

The present invention is a unique device for connecting the shape memory alloy spring and is completely free of the disadvantages described above. The connector reflecting the preferred embodiment of the present invention makes it possible to connect the terminals that feed power to the connector of the shape memory alloy spring. Crimping is applied to several portions. With this simple configuration, the connector embodied by the present invention prevents any shortage in power supply caused by poor connections and prevents any poor contact that might otherwise result from inadequate tensile strength. It thus makes it possible to stabilize terminal connections both mechanically and electrically.

DETAILED DESCRIPTION OF THE PREFERRED EMBODIMENT

Figure 1:
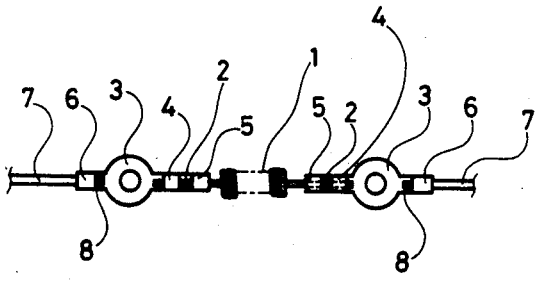
FIG. 1 is a simplified diagram of the key constituents of the connector reflecting the preferred embodiment of the present invention.
Figure 2:
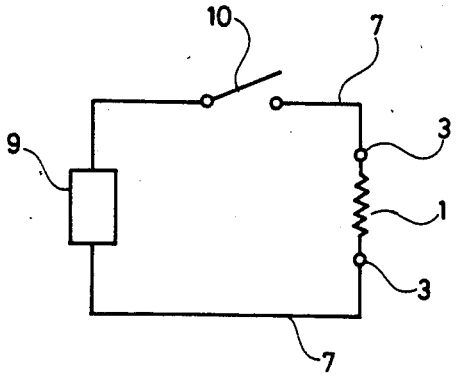
FIG. 2 is a circuit diagram of the connector device embodied by the present invention.

Referring now to the attached drawings, the preferred embodiment of the present invention is described below. As shown in FIG. 1, the connector device of the shape memory alloy spring embodied by the present invention positions two crimped portions 4 and 5 of the connection terminal 3 at one end of the shape memory alloy spring 1. The two designated portions 4 and 5 located at one end of the shape memory alloy spring 1 are crimped first. One end of the connection terminal 3 is connected to the spring connectors 2 on both sides of the shape memory alloy spring 1. The terminal connector 8 of the power supply line 7 is connected at the crimped portion 6 of the connection terminal 3. Finally, the other portion 6 of the connection terminal 3 is crimped to connect the connection terminal 3 to the terminal connector 8 of the power supply line. This completes the assembly. FIG. 2 is a simplified circuit diagram showing the connection of the shape memory alloy spring. Reference number 9 indicates the power supply line and number 10 indicates the switching means. In the above preferred embodiment, the description refers to the typical embodiment in which the two crimped portions 4 and 5 at one end of the connection terminal 3 are connected to the spring connectors 2 on either side of the shape memory alloy spring. However, the preferred embodiment does not define the number of crimped portions at one end of the connection terminal 3. This is because the crimping may be applied to more than two portions, even as many as 3 or 4 portions.

What is claimed:

1. A shape memory alloy spring connector assembly comprising:

a shape memory alloy spring having first and second ends;

first and second spring connectors connected to said first and second ends of said shape memory alloy spring;

first and second connection terminals connected to said first and second spring connectors; and power supply line connected to said connection terminals for feeding power to said shape memory alloy spring;

wherein a crimped connection is formed between said power supply line and each of said first and second connection terminals, a plurality of crimped connections are formed between said first connection terminal and said first end of said shape memory alloy spring, and a plurality of crimped connections are formed between said second connection terminal and said second end of said shape memory alloy spring, whereby said crimped connections provide for improved mechanical and electrical stability.

2. The shape memory alloy spring connector assembly of claim 1, wherein said plurality of crimped connections comprises two crimped connections.

* * * * *